US005147244A

United States Patent [19]

Spilde

[11] Patent Number: 5,147,244

[45] Date of Patent: Sep. 15, 1992

[54] VENTILATION SYSTEM INCLUDING VENT CONTROLLER APPARATUS

[76] Inventor: Rodney L. Spilde, 6300 W. Richmond Rd., Aberdeen, S. Dak. 57401

[21] Appl. No.: 755,506

[22] Filed: Aug. 30, 1991

[51] Int. Cl.[5] ..... F24F 7/02

[52] U.S. Cl. ..... 454/364; 49/324; 236/49.3; 454/363

[58] Field of Search ..... 49/324, 340, 345; 98/42.14, 42.16, 42.17, 42.19, 42.2; 236/49.3, 49.5

[56] References Cited

U.S. PATENT DOCUMENTS

| | | | |
|---|---|---|---|
| 87,668 | 3/1869 | Hayes . | |
| 438,099 | 10/1890 | Colton . | |
| 919,673 | 4/1909 | Anderson . | |
| 1,025,957 | 5/1912 | Bayley . | |
| 1,306,966 | 6/1919 | Marcoux et al. | 236/49.3 X |
| 1,410,314 | 3/1922 | Hyatt . | |
| 1,410,625 | 3/1922 | Sylvan . | |
| 1,618,792 | 2/1927 | Wood et al. . | |
| 1,952,350 | 3/1934 | Armstrong . | |
| 2,009,870 | 7/1935 | Black . | |
| 2,519,239 | 8/1950 | Eddison et al. . | |
| 2,538,319 | 1/1951 | Moore . | |
| 2,856,835 | 10/1958 | Horne . | |
| 3,139,276 | 6/1964 | Hay . | |
| 3,323,438 | 6/1967 | Korff . | |
| 3,392,658 | 7/1968 | Korff . | |
| 3,410,194 | 11/1968 | Reusch . | |
| 3,417,961 | 12/1968 | Shorrock . | |
| 3,422,573 | 1/1969 | Rich . | |
| 3,913,969 | 10/1975 | Hoch . | |
| 4,051,746 | 10/1977 | Liljeros . | |
| 4,206,571 | 6/1980 | Kramer et al. . | |
| 4,534,278 | 8/1985 | Spilde . | |
| 4,597,324 | 7/1986 | Spilde . | |
| 4,666,082 | 5/1987 | Spilde . | |
| 4,683,811 | 8/1987 | Huisinga et al. . | |
| 5,011,076 | 4/1991 | Wurtz . | |

FOREIGN PATENT DOCUMENTS

| | | | |
|---|---|---|---|
| 554135 | 6/1932 | Fed. Rep. of Germany . | |
| 1084172 | 6/1960 | Fed. Rep. of Germany | 49/340 |
| 2945 | of 1878 | United Kingdom | 98/42.2 |
| 481775 | 3/1938 | United Kingdom | 98/42.2 |

OTHER PUBLICATIONS

Four photographs and two sheets of drawings showing a ridge vent opener apparatus by Carroll Manufacturing, Inc.

Pp. 15 and 16 from *Gobbles*, dated Oct., 1986, discusses a system by Pal-Tech which includes a ridge vent opener apparatus shown in the photo on p. 15.

Two pages of a brochure by *Palls*, of Willmar, Minn.

*Primary Examiner*—Harold Joyce

*Attorney, Agent, or Firm*—Merchant, Gould, Smith, Edell, Welter & Schmidt

[57] ABSTRACT

A ventilation system for a building wherein first and second opposing doors are mounted adjacent an opening into the building. Each of the first and second doors include an axis of rotation parallel to each other and parallel to a major surface of each door. A bracket member is pivotally attached to the building for rotation about a first axis which is transverse to each axis of rotation of the first and second doors. Linkage structure is provided for connecting the bracket member to each of the first and second doors such that rotation of the bracket member about the first axis opens and closes the first and second doors. The linkage structure includes link rods connecting the bracket to the first and second doors. A three dimensional ball and socket joint is provided at each end of the first and second link rods to connect the link rods to the bracket and to the respective doors. The ventilation system permits more than one vent controller apparatus to be operated simultaneously to operate a single set of long vent doors or a plurality of sets of vent doors in aligned relationship with common axes of rotation for the vent doors. Connector structure, such as a cable is provided to connect the bracket members together for simultaneous operation. Automatic control includes a pneumatic device connected to temperature responsive structure.

12 Claims, 8 Drawing Sheets

VENTILATION SYSTEM INCLUDING VENT CONTROLLER APPARATUS

FIELD OF THE INVENTION

The present invention relates generally to ventilation systems for buildings. More particularly, the present invention relates to an automatic ventilation system for a building having a ridge vent, or roof vent, located at the peak of the building roof.

BACKGROUND OF THE INVENTION

Buildings, such as livestock confinement buildings, often include at least one vent opening closed off by at least one movable vent door which opens and closes to permit air to exit and/or enter the building. By opening and closing the door, or doors, ventilation of the interior of the building and also the temperature of the interior of the building can be controlled. Vent controller apparatus may be provided to maintain the vent door or doors in a desired position. Some vent controller apparatus are manually operated, others may be automatically operated. The building vents may be positionable in a plurality of positions between fully closed and fully opened.

Some of the buildings that include vents, including livestock confinement buildings, sometimes locate the vents at the peak or ridge of the roof of the building. These vents may also be referred to as ridge vents. In some cases, the ridge vents include opposing doors which are opened and closed simultaneously to ventilate the building and control the temperature of air within the building. Some ridge vent systems include ridge vent doors which extend substantial lengths along the peak of the roof. In some cases, the ridge vent doors may extend along the peak of the roof for several hundred feet. A common length for the vent doors is 8 feet. Sometimes splicers are used to connect adjacent sets of vent doors to form continuous lengths of vent doors. These long doors may be difficult to open and close properly due to their length. Further, since the vent doors are typically located at the peak of the roof, the vent doors are typically difficult to reach and operate properly Space concerns may also be a problem in the peak region of the roof.

In the case of livestock confinement buildings, it is important that the temperature be controlled within the building. Livestock typically cannot withstand temperatures outside a range of temperatures. Temperatures too warm or too cold could be harmful or deadly to the livestock. The temperature inside a livestock containment building is influenced by the temperature and weather conditions outside the building. The temperature inside the building is also influenced by the livestock inside the building. Because of varying conditions inside and outside the building, proper vent positioning may vary from day to day and also during the day. For manually positionable vents, the livestock owner must check on the temperature of the building periodically and make adjustments to the vent positioning as needed. To save time and money for the livestock owner, automatic temperature control is desirable.

Some vent controller apparatus exist which permit automatic opening and closing of the ridge vent doors based on temperature sensed inside the building. Some automatic systems are pneumatically operated. The vent controller apparatus may contain a pneumatically operated device for opening and closing one or more doors connected to the device. For the purpose of operating a long vent door, these pneumatically operated vent controller apparatus have been placed at periodic intervals along the ridge vent doors to facilitate proper opening and closing of the ridge vent door or doors.

Known vent controller apparatus have several problems, including being costly to manufacture and install, being difficult to adjust and maintain once installed, and being difficult to arrange and maintain to coordinate movement when opening a long continuous ridge vent door or doors or operating simultaneously a plurality of doors in a line.

Other mechanisms are known for opening and closing vent doors, windows, and other doors. However, the mechanisms do not permit easy manufacture, installation, and operation, especially in the case of using the apparatus to operate at least one, and preferably two ridge vent doors extending along the peak of a roof of a livestock confinement building.

It is clear that there is a long felt need for a ventilation system including a vent controller apparatus which easily and efficiently permits operation of one vent door, or two opposing vent doors, positioned along the roof of a building.

SUMMARY OF THE INVENTION

The present invention relates to a ventilation system for a building. In the preferred system, first and second opposing doors are mounted adjacent an opening into the building. Each of the first and second doors include an axis of rotation parallel to each other and parallel to a major surface of each door. A bracket member is pivotally attached to the building for rotation about a first axis which is transverse to each axis of rotation of the first and second doors. Linkage structure is provided for connecting the bracket member to each of the first and second doors. The linkage structure connects the bracket member to each door such that rotation of the bracket member about the first axis opens and closes the first and second doors.

In the preferred embodiment, the linkage structure includes a first link rod connecting the bracket to the first door. A second link rod connects the bracket to the second door. A three dimensional joint is provided at each end of the first and second link rods to connect the link rods to the bracket and to the respective doors. The three-dimensional joints permit three dimensional pivoting movement of each of the link rods relative to the bracket and relative to the respective doors during operation of the system.

Preferably, the three dimensional joint structure includes a ball and socket joint. In the preferred embodiment, each of the link rods is made from plastic and includes ball portions formed on each end. Socket portions connect each of the link rods to the bracket and to respective doors. The socket portions are preferably formed from molded plastic and comprise two separable members. The separable members are assembled around the ball portion of each end of the link rod to securely surround each ball portion to form the ball and socket joint.

The ventilation system of the present invention permits more than one vent controller apparatus to be operated simultaneously to operate a single set of long vent doors or a plurality of sets of vent doors in aligned relationship with common axes of rotation for the vent doors. When two or more vent controller apparatus are provided, connector structure, such as a cable, is provided to connect the bracket members together. In the preferred embodiment, a lever arm extends from each of the brackets and attaches to the cable. By applying a force to one end of the cable in a first direction to move the cable in the first direction, the vent controller apparatus will open the vent doors. By applying a force to the other end of the cable in the opposite direction to move the cable in the opposite direction, the vent controller apparatus will close the vent doors.

In the preferred ventilation system, a spring applies a biasing force on the cable to bias the cable toward a position to open the doors. A manual system for closing the vent doors includes a manually operated force applying device, such as a winch, which pulls the cable with varying force to oppose the spring bias force. The winch could alternatively be automatically controlled.

Preferably, a pneumatic device, such as an air cylinder, is attached to the end of the cable, instead of the winch, to apply a closing force on the cable in opposition to the spring bias force. For automatic control, the pneumatic device can be connected to temperature responsive structure. If the temperature responsive structure senses a temperature within the building which is too cool, the pneumatic device is activated to apply a greater force than the spring bias force to move the doors to a more closed position, or fully closed position. If the temperature responsive structure senses a temperature within the building which is too warm, the pneumatic device is activated to apply less of a force, or no force, on the cable such that the spring bias force moves the vent controller apparatus to position the doors in a more open or fully open position.

If, during operation, the doors are in a position between the fully open and the fully closed positions and the temperature responsive structure senses a desired temperature in the building, then the force applied by the pneumatic device is equal to the spring bias force and no movement occurs. Should the temperature sensed increase or decrease, then the pneumatic device is activated appropriately. In the event of pneumatic failure, the spring bias force places the doors in the open position to prevent livestock suffocation or other heat related problems.

The present invention provides structure for conveniently and more cost effectively providing control of movement and positioning of at least one, and preferably two opposing doors. The structure of the present invention permits easy mounting to the building and to the doors. The size of the opener apparatus permits convenient placement in the smaller confines of the roof peak area. Because the vent controller apparatus of the present invention are linkable, such as with a cable, automatic control of the system is easier and less costly since only a single temperature control apparatus is necessary to activate the system. Further, when pneumatics are employed to activate the system, less equipment and materials are needed. Moreover, a reduced number of air cylinders, air lines, and springs are typically required, thereby saving costs and reducing the chance of system failure.

These and other advantages of the invention over conventional systems will become more apparent after reading the description and claims which follow.

BRIEF DESCRIPTION OF THE DRAWINGS

Throughout the following views, reference numerals will be used on the drawings, and the same reference numerals will be used throughout the several views and in the description to indicate same or like parts of the invention.

DESCRIPTION OF THE PREFERRED EMBODIMENTS

Figure 1:
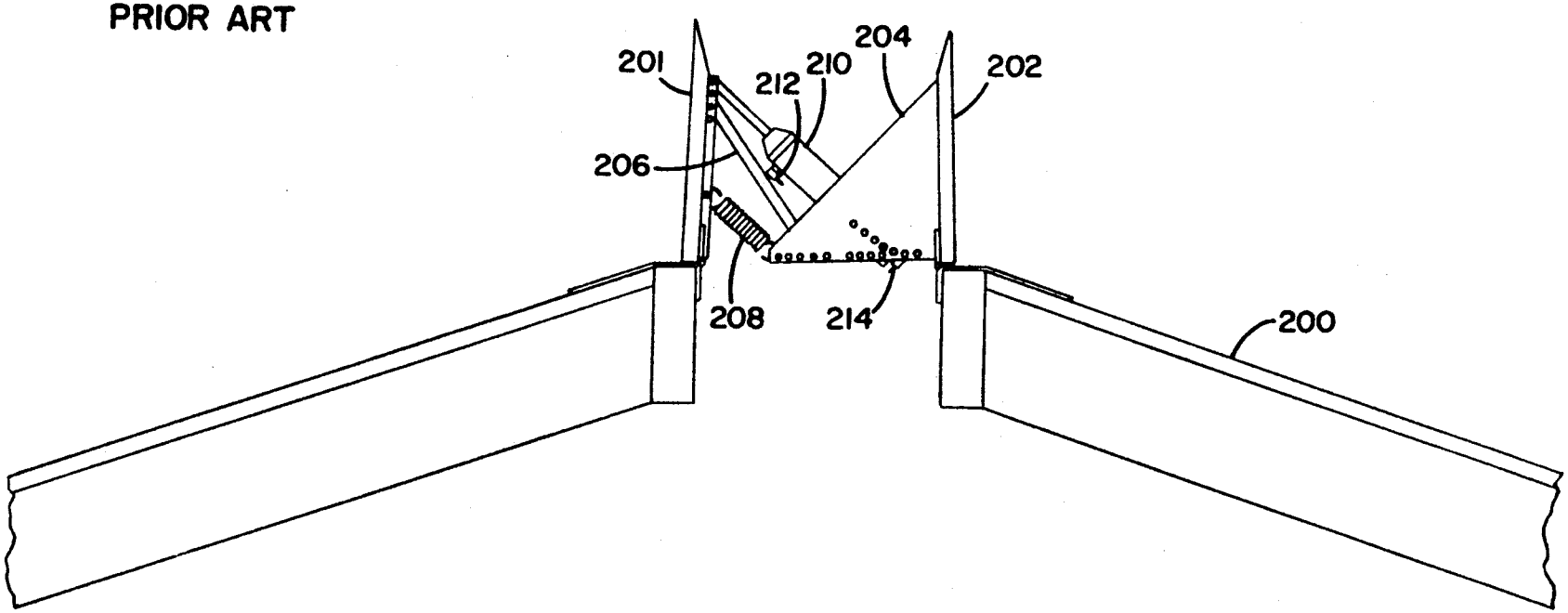
FIG. 1 PRIOR ART
FIG. 1 is an end view of a prior art ventilation system.

Referring now to FIG. 1, a prior art ventilation system is shown. Building 200 includes first door 201 and second door 202 which oppose each other. The doors 201,202 rotate toward each other to close, and rotate away from each other to open. Structure is provided to link the doors 201, 202 for simultaneous movement. The system includes a bracket 204 mounted to second door 202. A bar 206 links bracket 204 to first door 201. A pneumatic cylinder 210 also connects bracket 204 to first door 201. Pneumatic cylinder 210 is connected via conduit, or air lines (not shown), to a source of pressurized air.

By controlling the pneumatic pressures supplied to ends 212,214, the length of the pneumatic cylinder 210 can be varied. As the length of cylinder 210 is varied, the doors 201,202 are moved between positions. A spring 208 is provided to bias doors 210,202 toward the open position.

If the ventilation system is used in a livestock confinement building, typically the vent doors 201,202 extend for a considerable length along the roof of the building. In some cases, the vent doors may extend for lengths of 150 feet to 450 feet or greater. A common length for the vent doors is 8 feet. Sometimes splicers are used to connect some adjacent sets of vent doors to form continuous lengths of vent doors.

Whether the vent doors are connected with splicers or remain separate, typically the vent doors along the entire length of the roof are operated simultaneously. In order to operate continuous lengths of vent doors or a plurality of sets of vent doors, a plurality of mechanisms of the type shown in FIG. 1 are necessary to achieve proper movement of the vent doors. In the past, controller apparatus of the type shown in FIG. 1, including a bracket 204, a bar 206, a spring 208, and a pneumatic cylinder 210, are positioned at periodic intervals, such as 8 feet, along the peak of the roof. Separate air lines are connected to each of the cylinders 210.

Not only is the prior ventilation system more costly to manufacture, install and maintain, but the system is more likely to experience malfunctioning shutdowns due to the number of cylinders, amount of air line, and number of springs present to achieve properly functioning door operation.

In the event of failure of the mechanisms of the prior art system, access for repair is difficult. Other mechanisms are known for removing some of the structure from the roof peak area, but none of the systems are easy to coordinate in operation. Further, they do not address the problems of failure due to the number of air cylinders, air lines and springs. U.S. Pat. Nos. 4,597,324 and 4,638,811 disclose structure for opening opposing doors of a ridge vent wherein each opener apparatus has its own air cylinder.

Figure 2:
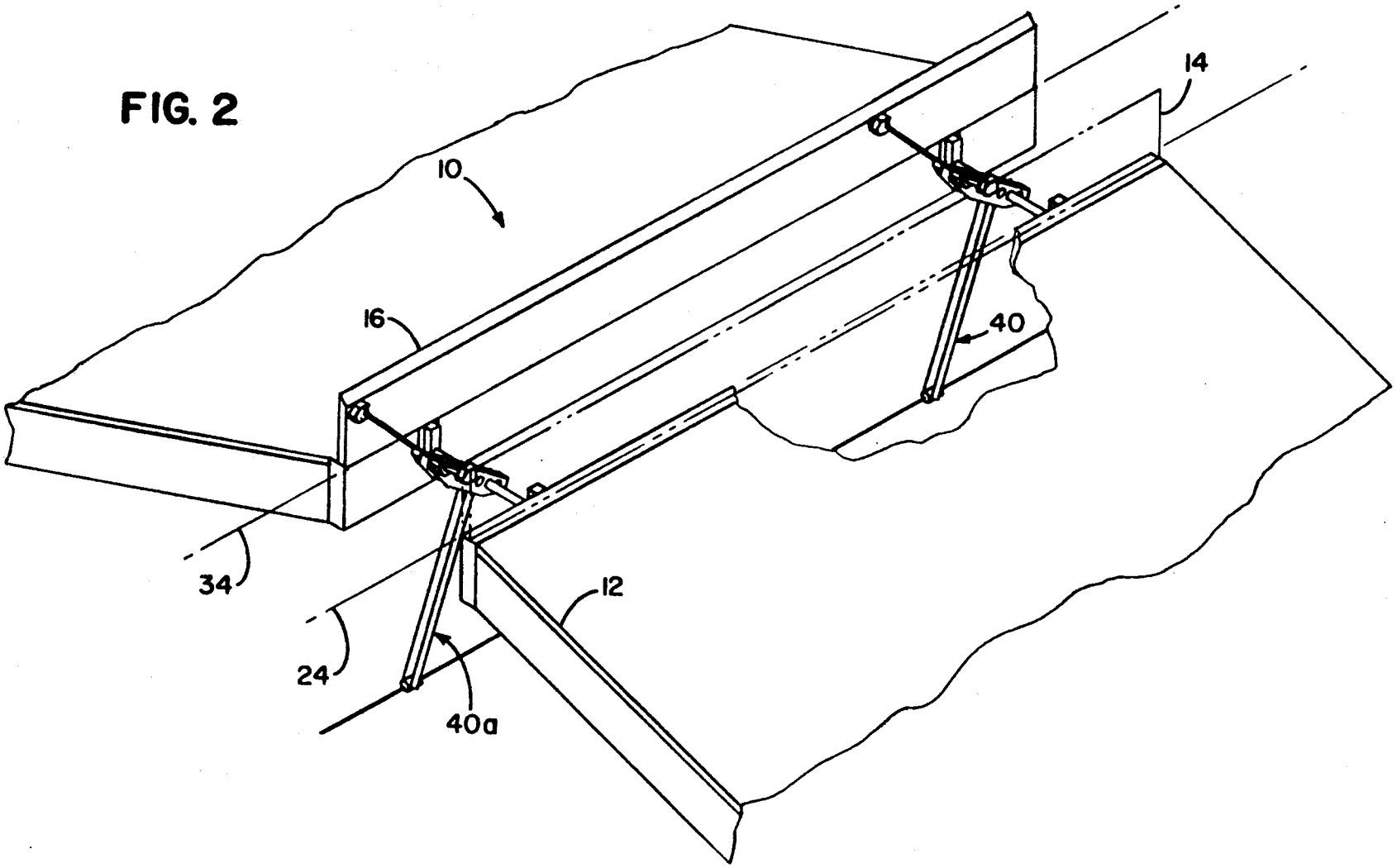
FIG. 2 is a perspective view of a preferred embodiment of the ventilation system according to the present invention for a building having a ridge vent.

Referring now to FIGS. 2–11, a ventilation system 10 is shown according to the present invention. Referring in particular to FIG. 2, a building roof 12 is shown having a first door 14 pivotally mounted to the roof 12. First door 14 is shown in phantom lines for clarity purposes. A second door 16 is pivotally mounted to roof 12. First door 14 and second door 16 are mounted adjacent an opening through the peak of the roof. First door 14 is mounted for pivotal movement about first axis 24. Second door 16 is mounted for pivotal movement about second axis 34. Doors 14,16 are opposing doors which pivot toward each other toward a closed position and pivot away from each toward a more open position. Axes 24,34 are parallel to each other and to major surfaces of each door 14,16. Two vent controller apparatus 40,40*a* are shown for controlling and positioning doors 14,16.

Figure 3:
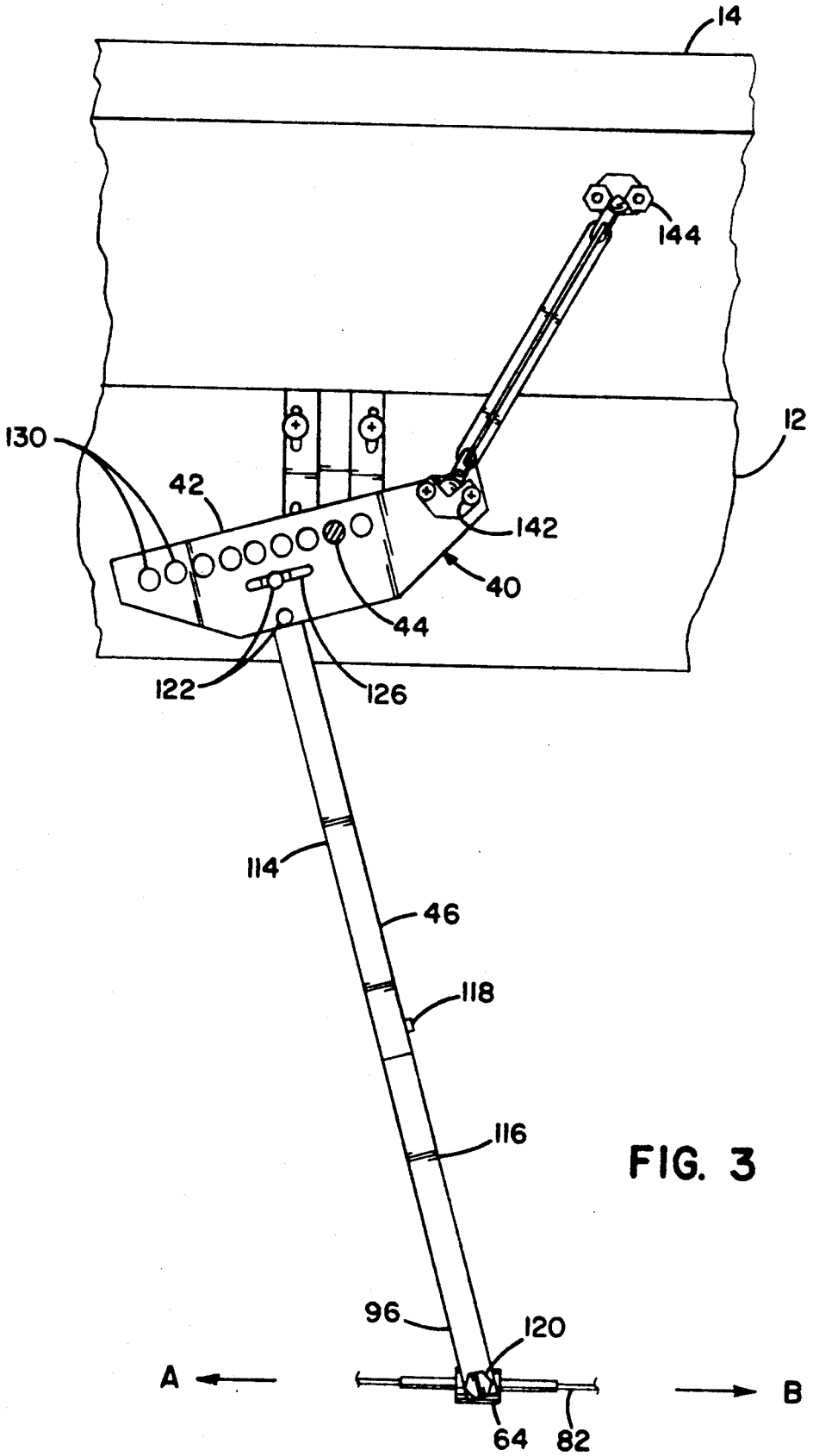
FIG. 3 is a side view of one of the vent controller apparatus of the ventilation system shown in FIG. 2.
Figure 5:
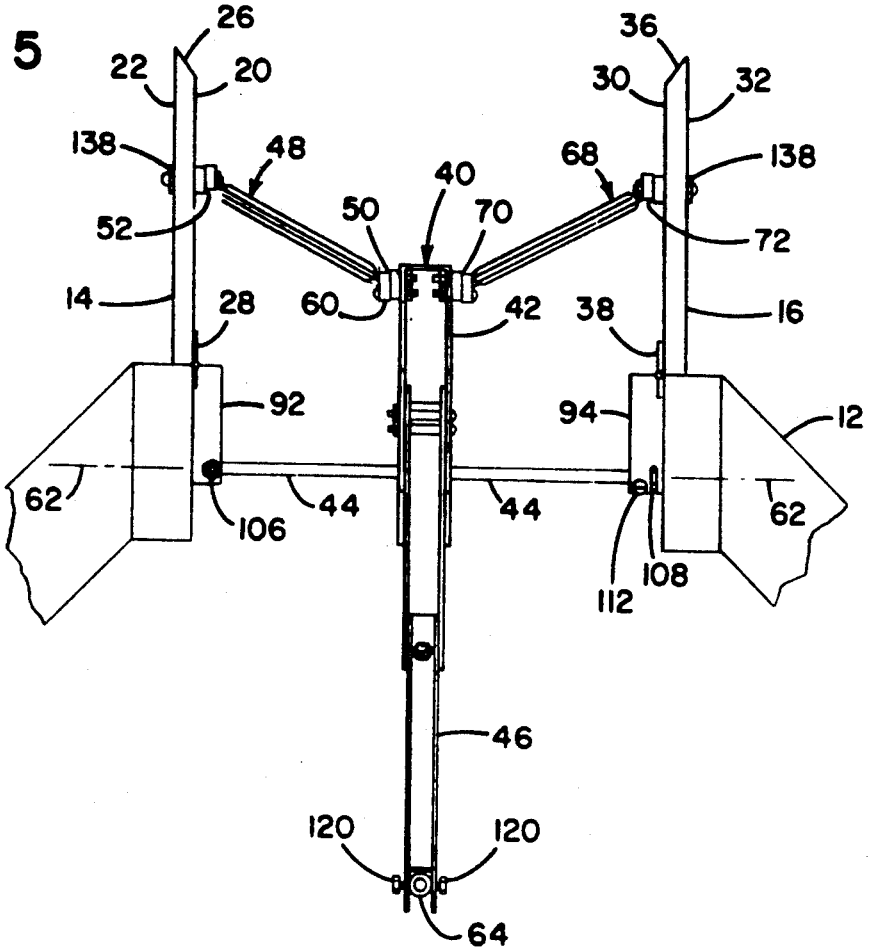
FIG. 5 is an end view of the vent controller apparatus shown in FIG. 3, showing the vent doors in the open position.
Figure 4:
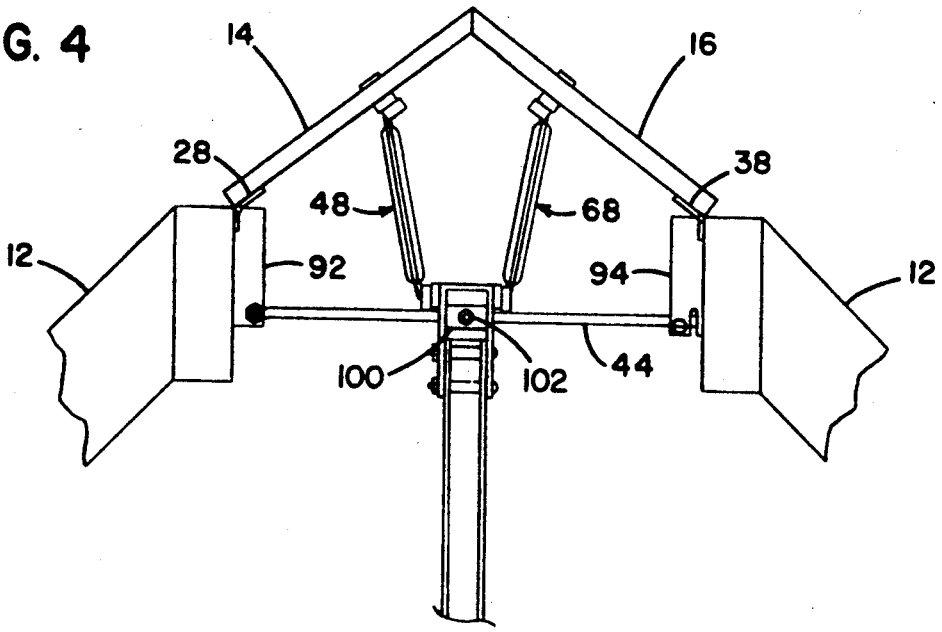
FIG. 4 is an end view of the vent controller apparatus shown in FIG. 3, showing the vent doors in the closed position.

Referring now to FIGS. 3–5, the structure of the ventilation system, including vent controller apparatus 40, is shown in greater detail. As best shown in FIGS. 4 and 5, hinge 28 attaches first door 14 to roof 12. Hinge 28 attaches to inside surface 20. Similarly, hinge 38 attaches to inside surface 30 of second door 16 to mount second door 16 to roof 12. Free end 26 of door 14 pivots toward and away from free end 36 of second door 16 during pivoting movement of each of the doors about its respective pivot axis. As shown in FIG. 4, free ends 26,36 of doors 14,16 meet to substantially completely close the opening through the roof 12 into the building. In some cases, it is desirable to insulate first door 14 and second door 16 between inside surface 20 and outside surface 22 and between inside surface 30 and outside surface 32.

The present invention includes vent controller apparatus, or door opener apparatus 40, for use in opening and closing doors 14,16. Door opener apparatus, referred to as opener 40, includes a bracket 42, as best shown in FIG. 3. Bracket 42 shown in the Figures is a U-shaped member.

As best shown in FIGS. 3–5, bracket 42 is mounted to roof 12 through elongated rod 44. In the preferred embodiment, bracket 42 rotates freely about elongated rod 44 to define a pivot axis 62 as shown in FIG. 5. Rod 44 passes through an opening on either side of bracket 42. Elongated rod 44 is mounted to roof 12 with left rod mounting bracket 92 and right rod mounting bracket 94.

Elongated bar 46 extends from bracket 42 and functions as a lever arm for receiving a force to rotate bracket 42 about pivot axis 62.

Connecting the bracket 42 to first door 14 is first link rod 48. A ball and socket joint 50 connects first link rod 48 to bracket 42. A second ball and socket joint 52 is formed at a second end of first link rod 48 to connect first link rod 48 to first door 14. The ball and socket joints 50,52 permit three-dimensional movement of the first link rod 48 relative to the bracket 42 and relative to the door 14 during rotational movement of bracket 42 about axis 62.

Second link rod 68 connects bracket 42 to second door 16. A first ball and socket joint 70 is provided to connect second link rod 68 to bracket 42. A second ball and socket joint 72 on second link rod 68 is provided to connect second link rod 68 to second door 16. The ball and socket joints 70,72 permit three-dimensional movement of the second link rod 68 relative to the bracket 42 and relative to the second door 16 during rotational movement of bracket 42 about axis 62.

It is to be appreciated that ball and socket joints 50,52,70,72 are the preferred structure for permitting three-dimensional movement of the link rods 48,68 relative to bracket 42 and doors 14,16. Other three-dimensional joints such as knuckle joints with double axle pin joints could be used instead.

As best shown in FIG. 3, elongated bar 46 receives a force in either direction A or direction B. A force applied in either of the directions to elongated bar 46 causes rotation of bracket 42 about the pivot axis concentric with elongated rod 44. When a force is applied at distal end 96 to bar 46, the force acts about a distance between distal end 96 and the pivot axis 62 defined by elongated rod 44. This force is transmitted through bracket 42 and results in a force applied at joints 50,70 which are at a spaced apart distance on bracket 42 from the pivot axis 62 of bracket 42 defined by elongated rod 44. This force is transmitted through the joints 50,70, through the respective link rods 48,68, to the respective doors 14,16, to result in movement of the doors 14,16.

In the configuration shown in FIG. 3, by rotating elongated bar 46 in the direction of arrow B, the force will be transmitted through the opener 40 to place the doors in an open position as shown in FIG. 5. By then applying a force in the direction of arrow A, the force is transmitted through the opener 40 to move the doors 14,16 from the open position of FIG. 5 toward the closed position of FIG. 4. Opener 40 permits positioning on the doors 14,16 in the closed position of FIG. 4, the open position of FIG. 5, or an infinite number of positions between either extreme position.

Opener 40 employs rotation of bracket 42 about pivot axis 62 during movement of doors 14,16. Bracket pivot axis 62 is transverse to axis 24 of first door 14 and also axis 34 of second door 16. Opener 40 permits the application of a force to the bracket 42 at a distance from pivot axis 62 in a plane parallel to the pivot axes 24,34 of first door 14 and second door 16 to result in rotation of the doors 14,16 about each of their respective pivot axes. Opener 40 permits any torque applied to bracket 42 about pivot axis 62 to result in opening and closing movement of doors 14,16 which, as noted above, have their pivot axes transverse to bracket pivot axis 62.

The opener 40 of the present invention permits activation of the opener 40 from a remote location. As noted previously, opener 40 can be activated by applying a force to distal end 96 of elongated bar 46. In the preferred embodiment, a cable 82 is attached to distal end 96 to apply a force in the direction of arrow B of FIG. 3 to open the doors 14,16. Cable 82 applies a force in the direction of arrow A to close the doors 14,16. By pulling on the cable from a remote location in the direction of arrow A, the doors can be closed without having to directly, either manually or automatically, rotate bracket 42. Similarly, a force can be applied to the cable in the direction of arrow B to facilitate opening of the doors 14,16 without having to directly, either manually or automatically, apply the force to bracket 42 necessary to open the doors.

Figure 6:
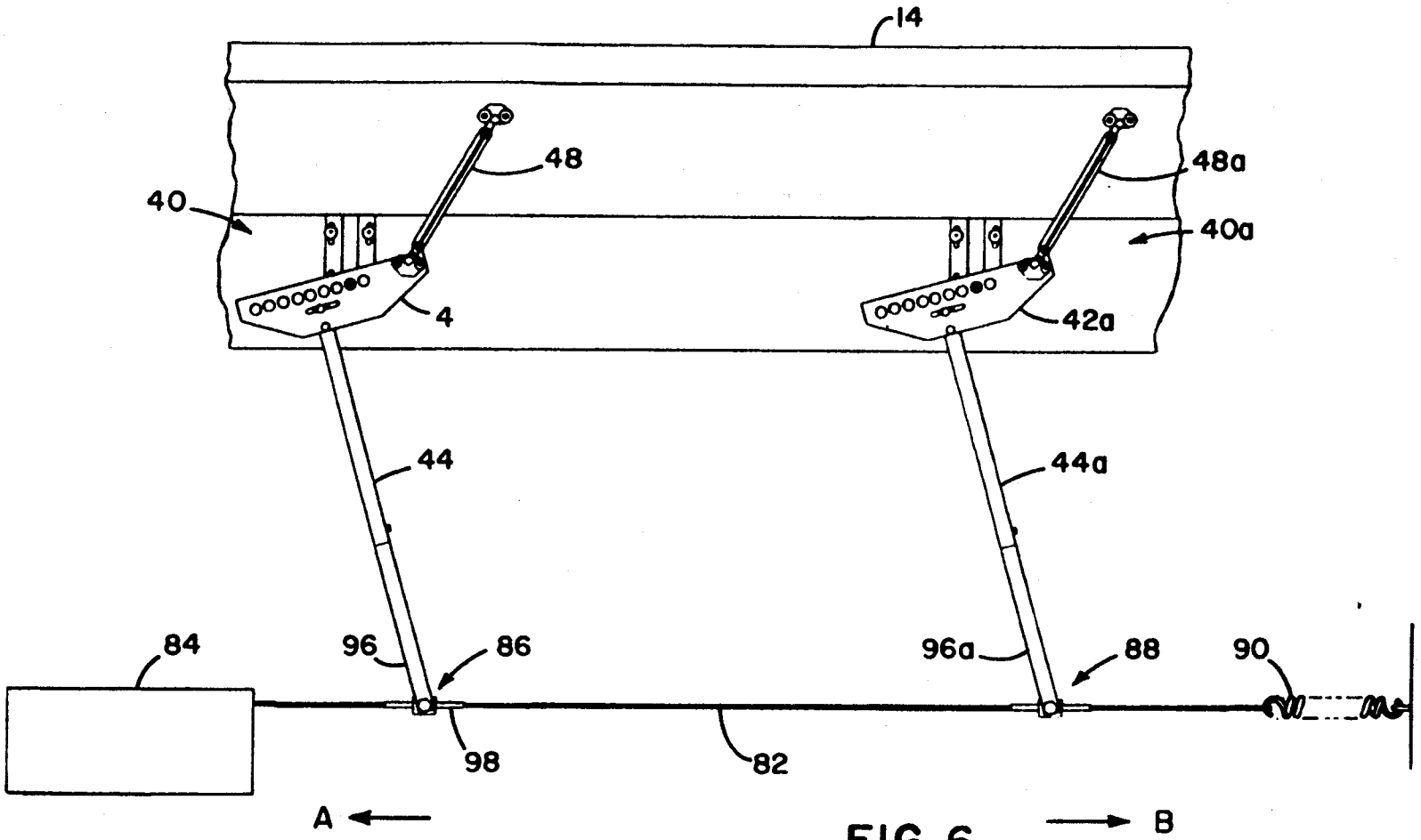
FIG. 6 is a schematic view of two vent controller apparatus linked together for simultaneous operation.

The structure of opener 40 facilitates simultaneous operation of opener 40 with a plurality of other similar openers 40 positioned to open the same doors 14,16, or to position sets of doors similar to doors 14,16 mounted with concentric axes of rotation to doors 14,16. FIG. 6 illustrates a schematic view of two openers 40,40*a* to open a pair of opposing doors. It is noted that FIG. 6 only shows one of the doors, door 14, for clarity purposes. It is to be appreciated that a second door is mounted similarly to the positioning of the doors as shown in FIGS. 2-5.

In FIG. 6, opener 40 is mounted to the building as shown in FIGS. 3-5. Second opener 40*a* is mounted similarly to opener 40 but at a spaced apart distance, typically about 8 feet, from opener 40 in a direction of the axes of rotation of the doors 14,16. Link rod 48*a* connects second bracket 42*a* to first door 14. Elongated rod bar 46*a* extends from bracket 42*a*. Bracket 42 and second bracket 42*a* are rotated simultaneously by the application of a force applied to elongated bar 44 and elongated bar 44*a*. Cable 82 connects distal end 96 of elongated bar 44 to distal end 96*a* of elongated bar 44*a*. A first end of cable 82 is attached to a force applying mechanism 84. The opposite end of cable 82 is attached to second end of a spring 90. The first end of spring 90 and the force applying mechanism 84 are fixedly attached to the ground or to the building. It is to be noted that additional openers like openers 40,40*a* can also be connected to cable 82 as needed whether they are connected to the same doors or separate doors designed to operate simultaneously.

When the force applying mechanism 84 applies a force to the cable 82 to move cable 82 in the direction of arrow A, the openers 40,40*a* rotate doors 14,16 toward the closed position. When the force applying mechanism 84 applies a force to the cable 82, spring 90 constantly applies an opposing force to cable 82 in the direction of arrow B. As long as the force applied by the force applying mechanism 84 is greater than the spring force applied by spring 90, the doors will continue to move toward the closed position. When the doors are completely closed, no further movement of cable 82 is permitted. Should it be desirable to open the doors 14,16, the force applied by the force applying mechanism 84 is reduced until the force applied by spring 90 begins to move the openers 40,40*a* to position the doors 14,16 in a more open position. If it is desirable to maintain the doors in a position between the fully open position and the fully closed position, the force applying mechanism 84 must apply a force equal to the spring force applied by spring 90 when the doors are in the intermediate position. Should it be desirable to completely open the doors, the force applying mechanism applies a force less than the spring force applied by spring 90 when the doors are in the completely open position. In some cases, the force applying mechanism 84 may apply a zero force to cable 82.

The force applying mechanism 84 applies a force in the direction of arrow A to close the doors. Should the force applying mechanism 84 fail and not apply any force to cable 82, spring 90 will act to open the doors. This results in a safety mechanism for the ventilation system. By opening the doors in the event of a failure, livestock may be saved from suffocation or heat stress should the force applying mechanism 84 fail on a day when ventilation is necessary in the building and a complete closure of the doors would adversely affect the livestock.

Force applying mechanism 84 may be a variety of different mechanisms. A manual mechanism for manually positioning doors 14,16 could employ a winch device, for example, for winding cable 82 to apply a force on cable 82 in a direction of arrow A. Any of a variety of conventional winches may be employed for this purpose.

Alternatively, the force applying mechanism 84 may include a pneumatic cylinder operable by changes in air pressure supplied to the cylinder. Operation of the air cylinder can be manually controlled. In the preferred embodiment, the pneumatic device is automatically controlled such that the positioning of the doors is based upon temperature sensed within the building. In this manner, a single pneumatic device can be used to control a plurality of openers 40. It is to be noted that the winch or other force applying mechanism noted above could be automated to apply a predetermined force to the cable based on temperature sensed.

Figure 11:
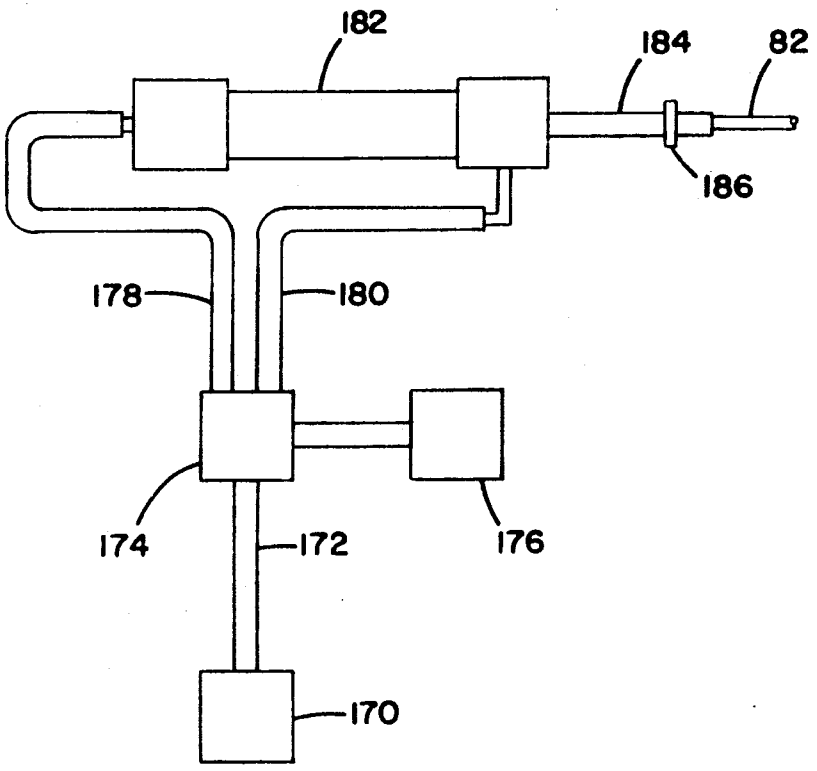
FIG. 11 is a schematic of an alternative pneumatic temperature control system for applying a closing force on the cable for the system shown in FIG. 6.
Figure 10:
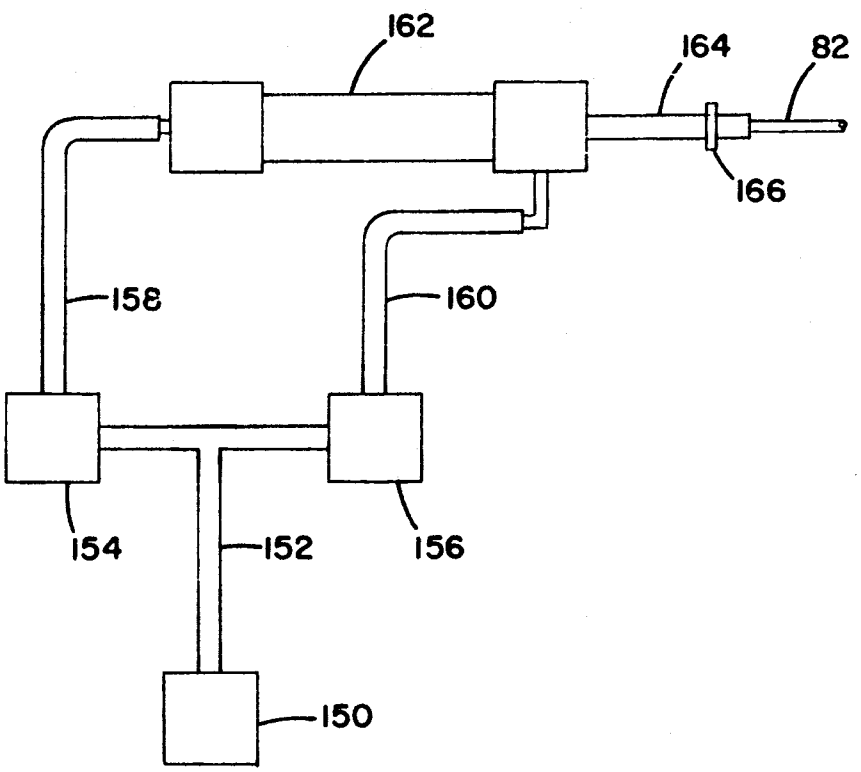
FIG. 10 is a schematic of a pneumatic temperature control system for applying a closing force on the cable for the system shown in FIG. 6.

FIGS. 10 and 11 illustrate in schematic view two different pneumatic temperature control systems for use in automatically positioning vent doors 14,16. The systems of FIGS. 10 and 11 illustrate in greater detail the structure usable for the force applying mechanism 84 shown in FIG. 6.

Referring now to FIG. 10, an air cylinder 162 has a longitudinally reciprocating rod 164 extending from the air cylinder 162. The cable 82 is connected to rod 164. Movement of rod 164 is controlled by pressurized air supplied to air cylinder 162. A source of pressurized air 150, typically an air compressor and an air tank, supplies pressurized air through conduit 152 to a pneumatic temperature control unit 156 and a pressure regulator 154. Pressure regulator 154 is connected by conduit 158 to air cylinder 162. Pressure regulator 154 controls the supply of pressurized air to the one end of air cylinder 162 through conduit 158. The pneumatic temperature control unit 156 controls the supply of pressurized air to the opposite end of air cylinder 162 through conduit 160. The position of rod 164 is determined by the relative pressures supplied to air cylinder 162 through conduit 160 and conduit 158.

Pressure regulator 154 located between air supply 150 and air cylinder 162 maintains an adjustable pressure acting to extend the rod 162 and facilitate opening of the doors. The pneumatic temperature control unit 156 controls the amount of air pressure supplied to air cylinder 162 through conduit 160 to oppose the pressure supplied by conduit 158. Rod 164 will only be retracted when the pressure supplied by conduit 160 is greater than the pressure supplied by conduit 158. Similarly, rod 164 will only be extended when the pressure supplied by conduit 158 is greater than the pressure supplied by conduit 160. Equal pressures will maintain the position of the rod 164.

The pneumatic temperature control unit 156 regulates temperature by controlling the amount of air pressure maintained in conduit 160 based on temperature sensed. For example, should the pneumatic temperature control unit 156 sense a temperature within the building which is too cool and the doors are not fully closed, the pneumatic temperature control unit 156 will permit conduit 160 to be provided with a pressure greater than back pressure supplied by conduit 158. When this pressure is greater than the back pressure, rod 164 will retract, thereby exerting a force on cable 82. This force results in positioning the doors in a more closed position. Continued sensing of temperatures below the desired temperatures will result in a complete closure of the doors.

If the pneumatic temperature control unit 156 then senses an increase in temperature which reaches the desired temperature due to the door closure, the pneumatic temperature control unit 156 reduces the pressure supplied in conduit 160 such that it is equal the pressure supplied by conduit 158 to maintain the positions of the doors.

Should the pneumatic temperature control unit 156 sense a temperature greater than the desired temperature within the building and the doors are not fully opened, the pneumatic temperature control unit 156 will reduce the pressure supplied in conduit 160 such that the pressure in conduit 160 is less than the back pressure supplied by conduit 158. This permits an extension of rod 164. By extending rod 164, spring 90 will move cable 82, thereby opening the doors a greater amount.

When the pneumatic temperature control unit 156 then senses a decrease in temperature which reaches the desired temperature, the pneumatic temperature control unit 156 increases the pressure supplied in conduit 160 such that it is equal the pressure supplied by conduit 158 to maintain the positions of the doors.

FIG. 10 illustrates a stop 160, which can be positioned on rod 164 to limit the amount of closing possible with respect to doors 14,16.

Air supply 150, including an air compressor and air tank, the conduit 152,158,160, and the air cylinder 162 are all commercially available components. Similarly, pneumatic temperature control unit 156 is also commercially available. Two pneumatic temperature control units 156 which also may be useful in the ventilation system of the present invention include temperature control units disclosed by U.S. Pat. Nos. 4,666,082, and 5,011,076.

It has been noted that vent doors 14,16 of many livestock containment buildings are fairly easy to move with only minimal force applied in the appropriate locations. It has been found in the case of using a pneumatic temperature control system of the type in FIG. 10 that a back pressure maintained at about 20 psi and a mainline pressure with a maximum limit of 90 psi is typically adequate to position the doors in many cases with appropriately positioned and sized openers 40.

FIG. 11 illustrates an alternative pneumatic temperature control system for automatically positioning the doors 14,16. As shown in FIG. 11, an air supply 170, including typically an air compressor and an air tank, supplies pressurized air through conduit 172 to an electrically actuated air valve 174. The air valve 174 switches the pressurized air provided by the air supply 170 between conduit 178 and conduit 180, which are connected to opposite ends of air cylinder 182. Rod 184 is longitudinally reciprocable as the pressures supplied by conduit 178 and conduit 180 are varied. Thermostat 176 controls operation of the electrically actuated air valve 174. Depending on the temperature sensed by the thermostat 176, the air valve 174 alternately supplies air to conduit 178 or conduit 180.

When thermostat 176 senses a temperature above the desired temperature in the building and the doors are not completely opened, the thermostat actuates air valve 174 to supply pressurized air to conduit 178 to permit air cylinder 182 to extend rod 184. In that case, conduit 180 is vented to the atmosphere to permit movement of rod 184 of air cylinder 182. This permits opening of the doors to a more open position. Continued sensing of a temperature above the desired temperature will eventually position the doors in the completely open position.

Should thermostat 176 sense a temperature which is below the temperature desired in the building and the doors are not fully closed, the thermostat 176 activates the air valve 174 to supply pressurized air to conduit 180 to permit retraction of rod 184. Conduit 178 is vented to the atmosphere. Pressure supplied to conduit 180 permits retraction of rod 184 to apply a force on cable 82 to move the doors to a more closed position. Continued sensing of a temperature below the desired temperature will eventually position the doors in the completely closed position. Stop 186 is provided if a limiting device is necessary to limit the amount of closure of the doors.

The pneumatic temperature control systems illustrated schematically by FIGS. 10 and 11 are designed so that the doors can be positioned in an infinite number of positions between a fully opened position and a fully closed position. By providing a continuum of positions, less abrupt changes in temperature within the building should occur. The system of FIG. 10 may be desirable over the system of FIG. 11 because the system of FIG. 10 is generally smoother during pressure shifts to change the direction of movement of the rod of the air cylinder.

It is to be appreciated that other temperature sensing systems could be employed to apply a force on cable 82 to control movement of doors 14,16 other than the pneumatic temperature control systems noted above.

In the preferred embodiment, bracket 42, elongated bar 46, and elongated rod 44 are made from metal. In the preferred embodiment, first link rod 48 and second link rod 68 are made from plastic. Preferably, the plastic is a glass impregnated nylon. The first and second link rods 48,68 include an elongated portion terminating in a ball portion at each end. The link rods 48,68 are further configured such that should the door connected t the link rod be blocked from moving toward a more open position, the respective link rod will break, thereby preventing damage to the remainder of the system. Once the link rod is broken, it must be replaced. This is a cost-effective and simple approach to prevent destruction of the other parts of system should one of the doors be obstructed from opening, such as due to ice formation.

Figure 9:
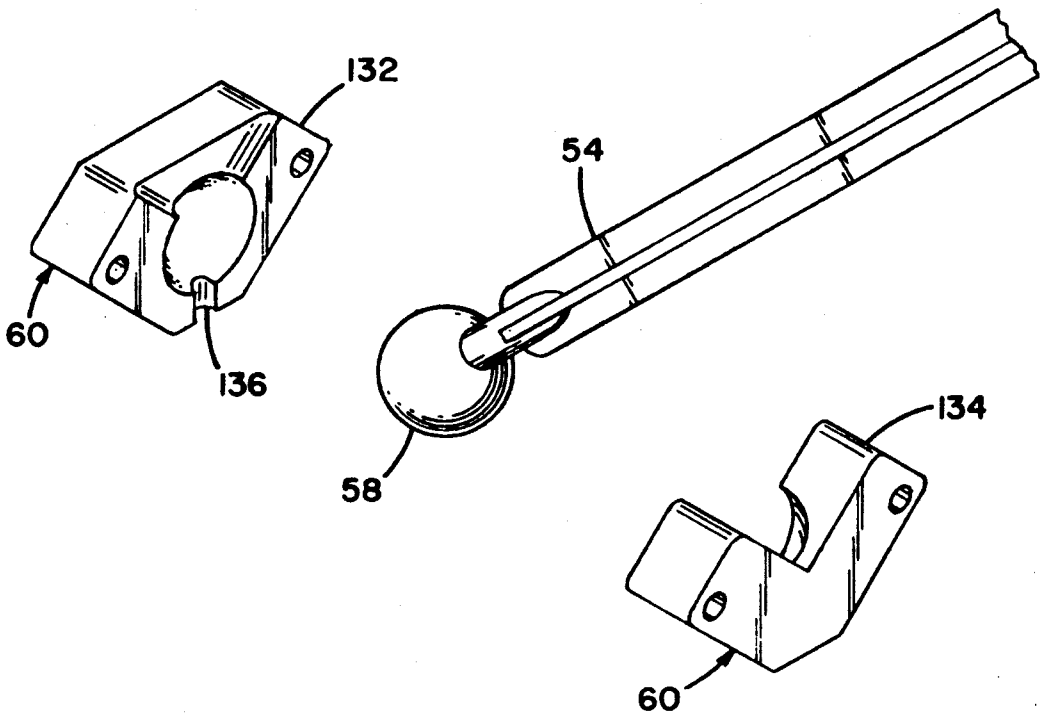
FIG. 9 is an enlarged perspective exploded assembly view of one of the ball and socket joints.

Referring now to FIG. 9, the preferred structure of ball and socket joint 50 is shown in greater detail. The structure of ball and socket joint 50 is similar to that of the other ball and socket joints 52,70,72. Ball portion 56 extends from elongate portion 54. Ball portion 56 is received within a recess of socket portion 60. In the preferred embodiment, socket portion 60 is also made from compatible plastic, which permits rotation of the ball portion 56 within the recess of the socket portion 60. In the preferred embodiment, socket portion 60 comprises a first half 132 and a second half 134, which are assembled around ball portion 56 to form a secure ball and socket joint. A notch 136 is provided to permit particulate and liquid matter to exit the recessed portion of the joint. This facilitates a smooth-operating and long-lasting ball and socket joint. Screws 142 and nuts 144 (shown in FIG. 3 for two separate socket portions) provide attachment structure for mounting the first half 132 to second half 134 of each socket portion. The screws are inserted through the holes in each half of the socket portion 60 shown in FIG. 9.

Each ball and socket joint 50,70,52,72 includes similar structure to the structure shown for joint 50 in FIG. 9. Each of the socket portions attaches either to one of the respective doors 14,16 or to bracket 42. In the case of attachment to the doors 14,16, a backing plate 138, functioning like a washer, is provided on the outside surface of each of the doors to prevent the screws 140 from being pulled through the door structure. The preferred backing plate is a one piece structure, with two holes, one for each screw.

In the preferred embodiment, elongated rod 44 is slidably received by one of the holes 130 through bracket 42 as shown in FIG. 3. As best shown in FIGS. 4, a mounting shaft lock sleeve is positioned on elongated rod 44 to maintain elongated rod 44 in the proper position relative to bracket 42. A set screw 102 facilitates attachment of the mounting shaft lock sleeve 100 to elongated rod 44.

Figure 7:
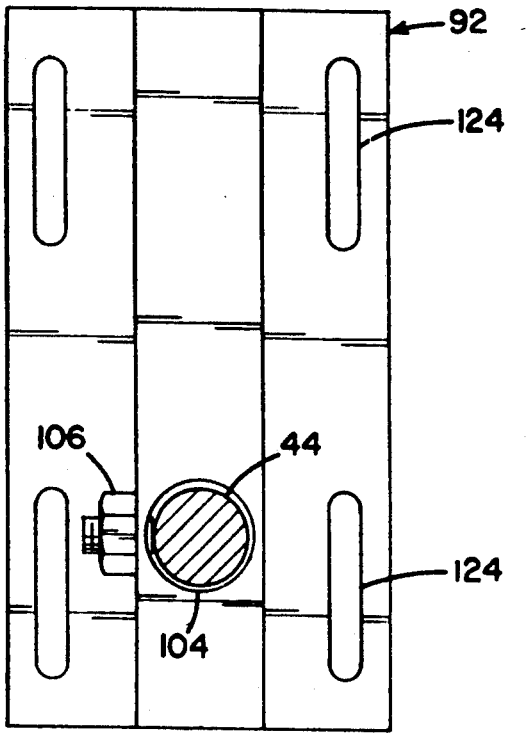
FIG. 7 is a view of the left rod mounting bracket for mounting the vent controller apparatus to the building. The view in FIG. 7 is an enlarged side view of the left rod mounting bracket shown in FIGS. 4 and 5.
Figure 8:
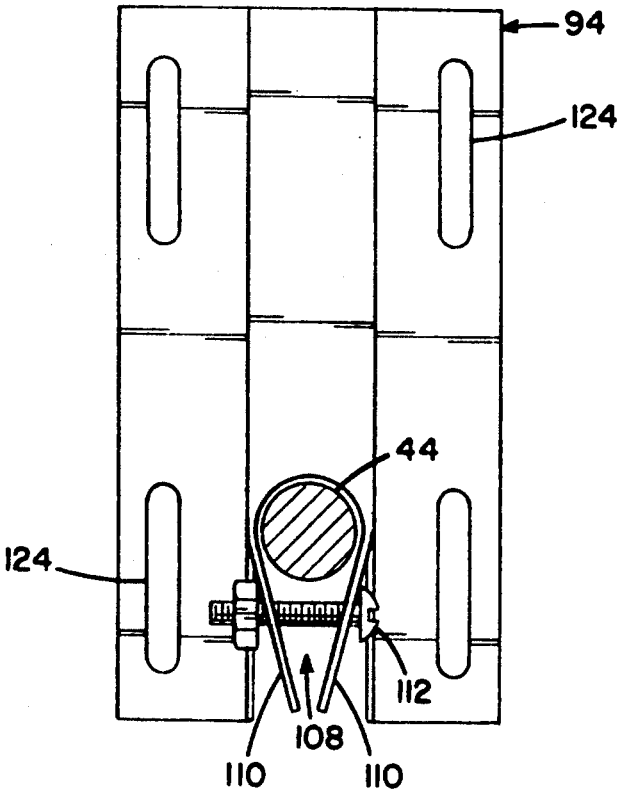
FIG. 8 is a view of the right rod mounting bracket for mounting the vent controller apparatus to the building. The view in FIG. 8 is an enlarged side view of the right rod mounting bracket shown in FIGS. 4 and 5.

FIGS. 7 and 8 illustrate the left and right rod mounting brackets 92,94 in greater detail. Rod mounting brackets 92,94 are first mounted to the building during installation of opener 40. Elongated rod 44 is first mounted in left rod mounting bracket 92 through opening 104. The rod 44 is fixed in place with set screw 106 as shown in FIG. 7. The opposite end of elongated rod 44 is positioned in slot 108 of rod mounting bracket 94. Free ends 110 of rod mounting bracket 94 are pinched together with screw and nut 112 to mount elongated rod 44 to rod mounting bracket 94 as shown in FIGS. 4, 5, and 8. Once elongated rod 44 is mounted to the building, the link rods 48,68 are attached to the respective doors.

The present invention also includes various structures permitting flexibility of usage of opener 40 with a variety of different door systems. Elongated bar 46 is adjustable in length with top piece 114 and bottom piece 116 fixed by screw 118. By adjusting the length of elongated bar 46 and fixing with screw 118, the bar can be extended to a convenient height for receiving cable 82. This adjusting structure is shown in FIGS. 3-5. Extra holes (not shown) are provided for permitting the actual extension/retraction. Each of the top and bottom pieces is U-shaped.

To facilitate easy attachment of the distal end 96 of elongated bar 46 to cable 82, a cable clamp sleeve 64 is provided. The cable clamp sleeve 64 is pivotally attached to the distal end 96 of elongated bar 46 through bolts 120. Bolts 120 screw through bar 46 into cable clamp sleeve 64 for holding cable 82 with respect to distal end 96. A cable protector 98 is provided to protect the cable.

As shown in FIG. 3, bracket 42 is provided with a plurality of openings or holes 130 for receiving the elongated rod 44. Typically, elongated bar 44 may be positioned in one of the holes 130 depending on the width of the opening through the roof. Also impacting the configuration and dimensions of opener 40 is the amount of desired movement of bracket 40 and bar 46, and the desired amount of movement of doors 14,16. It is to be appreciated by those skilled in the art that these dimensions and positions can be determined through calculation for proper installation for the specific opening width, door dimensions provided, and movement desired.

FIG. 3 also illustrates slots 126 provided on bracket 42 for varying the angle of attachment of elongated bar 46 relative to bracket 42. A second set of slots is provide on bar 46 to cooperate with slots 126 to vary the angle. The slots on the bar are not shown in the Figures but run parallel to the longitudinal direction of bar 46.

FIGS. 7 and 8 also illustrates slots 124 provided on rod mounting brackets 92,94 to facilitate height adjustment should it be necessary in the particular circumstances.

The invention is not to be construed as limited to the specific embodiments shown in the drawings, but is to be limited only by the broad general meanings of the following claims.

What is claimed is:

1. A ventilation system for a building, comprising:

first and second opposing doors mounted adjacent an opening into the building, each of the first and second doors including an axis of rotation parallel to each other and parallel to a major surface of each door;

a first bracket member pivotally attached to the building for rotation about a first axis transverse to each axis of the first and second doors; and linkage means for connecting the bracket member to each of the first and second doors, wherein rotation of the bracket member about the first axis in a first direction opens the first and second doors, and rotation of the bracket member about the first axis in an opposite direction closes the first and second doors;

the linkage means including:

a first link rod with a first end and a second end;

first three-dimensional connector means for mounting the first end of the first link rod to the first door;

second three-dimensional connector means for mounting the second end of the first link rod to the bracket, the first and second three-dimensional connector means permitting three-dimensional pivoting movement of the first link rod relative to the first door and relative to the bracket during rotation of the bracket;

a second link rod with a first end and a second end;

third three-dimensional connector means for mounting the first end of the second link rod to the second door; and fourth three-dimensional connector means for mounting the second end of the second link rod to the bracket, the third and fourth three-dimensional connector means permitting three-dimensional pivoting movement of the second link rod relative to the second door and relative to the bracket during rotation of the bracket.

2. The ventilation system of claim 1, wherein at least one of the first, second, third, and fourth three-dimensional connector means includes a ball and socket joint.

3. A vent controller apparatus for opening and closing two opposing doors of a building, the apparatus comprising:

a bracket member pivotally attachable to the building for rotation about an axis;

a first link rod having a first end and a second end;

a second link rod having a first end and a second end;

first and second door connector means for connecting a respective one of the first and second link rods to one of the doors at the first ends of the link rods, the first and second door connector means permitting three-dimensional pivoting movement of each of the link rods with respect to the respective door during rotational movement of the bracket; and first and second bracket connector means for connecting a respective one of the first and second link rods to the bracket at the second ends of the link rods, the first and second bracket connector means permitting three-dimensional pivoting movement of each of the link rods with respect to the bracket during rotational movement of the bracket.

4. The vent controller apparatus of claim 3, further comprising temperature responsive control means for rotating the bracket to position the doors based on air temperature sensed.

5. The vent controller apparatus of claim 3, wherein the bracket includes a force-receiving lever arm, the lever arm receiving an external force to cause rotation of the bracket, thereby opening and closing the doors.

6. The vent controller apparatus of claim 3, wherein the first and second link rods are made from plastic.

7. The vent controller apparatus of claim 6, wherein the first and second link rods are configured to break during rotation of the bracket to open the doors connected to the first and second link rods should one or both of the doors be prevented from moving toward the open position.

8. The vent controller apparatus of claim 3, wherein the first and second door connector means each includes a ball and socket joint including a ball portion and a socket portion, and wherein the ball portion of each ball and socket joint forms the first end of the respective first and second link rods, and wherein the socket portions of each ball and socket joint are mounted to the respective doors.

9. The vent controller apparatus of claim 3, wherein the first and second bracket connector means each includes a ball and socket joint including a ball portion and a socket portion, and wherein the ball portion of each ball and socket joint forms the second end of the respective first and second link rods, and wherein the socket portions of each ball and socket joint are mounted to the bracket.

10. A vent controller apparatus for opening and closing a door of a building, the door rotatable about an axis parallel to a major surface of the door, the controller apparatus comprising:

a bracket member pivotally attachable to the building for rotation about a first axis transverse to the axis of rotation of the door;

a link rod including an elongate portion extending between first and second ends, the first and second ends each including a ball portion;

a first socket portion attachable to the door, the first socket portion receiving the ball portion of the first end of the link rod to form a first ball and socket joint; and a second socket portion attached to the bracket, the second socket portion receiving the ball portion of the second end of the link rod to form a second ball and socket joint.

11. The vent controller apparatus of claim 10, wherein at least one of the first or second socket portions includes two separable members, and means for attaching the two separable members, the separable members being assembled around the ball portion of the first end or the second end of the link rod to form the ball and socket joint.

12. The vent controller apparatus of claim 10, wherein the first socket portion and the second socket portion each include a drainage notch permitting drainage and removal of liquid and particulate from each of the first and second ball and socket joints.

* * * * *